US010975864B2

(12) United States Patent
Trossmann et al.

(10) Patent No.: US 10,975,864 B2
(45) Date of Patent: Apr. 13, 2021

(54) SCREW PUMP

(71) Applicant: LEISTRITZ PUMPEN GMBH, Nürnberg (DE)

(72) Inventors: Oliver Trossmann, Oberasbach (DE); Ralf Richter, Fürth (DE)

(73) Assignee: LEISTRITZ PUMPEN GMBH, Nürnberg (DE)

( * ) Notice: Subject to any disclaimer, the term of this patent is extended or adjusted under 35 U.S.C. 154(b) by 208 days.

(21) Appl. No.: 16/136,399

(22) Filed: Sep. 20, 2018

(65) Prior Publication Data

US 2019/0085844 A1 Mar. 21, 2019

(30) Foreign Application Priority Data

Sep. 21, 2017 (DE) ..... 10 2017 121 882.3

(51) Int. Cl.
*F04C 15/00* (2006.01)
*F04C 2/16* (2006.01)
(Continued)

(52) U.S. Cl.
CPC ..... *F04C 15/0046* (2013.01); *F01C 21/02* (2013.01); *F04C 2/16* (2013.01);
(Continued)

(58) Field of Classification Search
CPC ..... F04C 2240/56; F04C 2240/50; F04C 2240/54; F04C 15/0042; F04C 2/165;
(Continued)

(56) References Cited

U.S. PATENT DOCUMENTS 2,466,888 A * 4/1949 Garraway ..... F04C 2/16 418/202
3,811,805 A 5/1974 Moody, Jr. et al.
(Continued)

FOREIGN PATENT DOCUMENTS

CN 103711690 A 4/2014
CN 206035802 3/2017
(Continued)

OTHER PUBLICATIONS

DE3010606 translation (Year: 1981).*
(Continued)

*Primary Examiner* — Devon C Kramer
*Assistant Examiner* — David N Brandt
(74) *Attorney, Agent, or Firm* — Lucas & Mercanti, LLP; Klaus P. Stoffel

(57) ABSTRACT

A screw pump with a housing; a housing cover; at least one idler screw held in a bore in the housing; and a bushing arranged on the housing cover with a receiving space bounded by a cylindrical flange, into which one end of the idler screw engages; wherein the bushing has an opening in its base, through which a fluid, supplied by a feed channel in the cover, can be supplied from the end opposite the idler screw under pressure to the end surface of the idler screw, wherein the bushing engages with radial play in a receptacle in the cover and comprises a radial flange, by which it is supported axially on the housing; and wherein at a least certain part of the ring-shaped flange of the bushing engages in the bore and is accommodated therein with play.

19 Claims, 4 Drawing Sheets

(51) Int. Cl.
*F01C 21/02* (2006.01)
*F04C 13/00* (2006.01)

(52) U.S. Cl.
CPC ..... *F04C 2/165* (2013.01); *F04C 15/0042* (2013.01); *F04C 13/002* (2013.01); *F04C 15/0034* (2013.01); *F04C 2240/30* (2013.01); *F04C 2240/56* (2013.01); *F04C 2270/0445* (2013.01)

(58) Field of Classification Search
CPC ..... F04C 2/16; F04C 15/0046; F01C 21/02; F01C 21/003; F01C 21/005
See application file for complete search history.

(56) References Cited

U.S. PATENT DOCUMENTS

| | | | | |
|---|---|---|---|---|
| 4,028,025 | A | 6/1977 | Lonnebring | |
| 2011/0268598 | A1* | 11/2011 | Paval | F04C 15/0038 418/83 |
| 2014/0070530 | A1* | 3/2014 | Haeckel | F16L 21/035 285/346 |

FOREIGN PATENT DOCUMENTS

| | | | | |
|---|---|---|---|---|
| DE | 2324967 | A | 12/1973 | |
| DE | 2618300 | A1 | 11/1976 | |
| DE | 2828348 | A1 | 1/1980 | |
| DE | 3010606 | A1 * | 10/1981 | F04C 15/0042 |
| EP | 0889240 | A1 | 1/1999 | |
| FR | 2367929 | A1 | 5/1978 | |
| GB | 1549546 | A | 8/1979 | |
| GB | 2023739 | * | 1/1980 | F04C 15/00 |
| GB | 2023739 | B | 7/1982 | |

OTHER PUBLICATIONS

European Search Report, EP18182916, dated Jan. 25, 2019.
Chinese Office Action and English Translation Therof, Appl. No. 201811090337.0, dated Sep. 18, 2019, 8 Pages.

* cited by examiner

SCREW PUMP

CROSS-REFERENCE TO RELATED APPLICATIONS

The present application claims priority of DE 10 2017 121 882.3, filed Sep. 21, 2017, the priority of this application is hereby claimed and this application is incorporated herein by reference.

BACKGROUND OF THE INVENTION

The invention pertains to a screw pump with a housing; a housing cover; at least one idler screw accommodated in a bore in the housing; and a bushing arranged on the housing cover, which bushing has a receiving space bounded by a cylindrical flange, in which one end of the idler screw engages, wherein the bushing has an opening in its base, through which fluid supplied through a feed channel in the cover from the end opposite the idler screw can be supplied under pressure to the end surface of the idler screw.

Screw pumps serve to convey a wide variety of fluid media. They comprise a housing with at least two screws, namely, a drive screw and at least one idler screw driven by the drive screw, wherein, however, two idler screws are frequently provided, one arranged on either side of the central drive screw. The one or more idler screws are driven by the drive screw after the screws have meshed with each other. As a result of this engagement, cavities are formed, which represent the transport spaces for the fluid to be conveyed. In this way it is possible for the fluid supplied to one side to be conveyed from this suction side to the pressure side. The fundamentals of the structure and function of a screw pump of this type are known.

Because the idler screws have a slight amount of axial freedom of movement, it is necessary to provide axial thrust compensation, which, in the known screw pumps, is achieved hydraulically. For this purpose, a bushing is provided on the housing cover; this bushing is configured as a blind bushing. At the end facing the cover, the bushing is fastened by several bolt connections, wherein the fastening is such that a slight amount of lateral movement is possible in the no-load state. The free cylindrical end of the idler screw fits into this bushing with a small amount of play. This free end of the screw and the cylindrical flange of the bushing are located in an open space in the housing; this means that the idler screw projects from the housing bore itself and enters the blind bushing in this open space. To achieve the desired hydraulic axial thrust compensation, a fluid, usually the fluid to be conveyed, which is fed back via a feed channel from the pressure side, is conducted from the base of the bushing into the receiving space via an axial bore, which, in the known screw pumps, is provided by an elongated, longitudinally bored screw; the fluid in the receiving space then presses against the end surface of the idler screw. Thus the axial thrust compensation is realized by a hydrostatically pressurized space located between the bushing and the idler screw. In known screw pumps, the diameters of the pressure-impinged surfaces are considerably overcompensated which always leads to a resultant force component which presses the bushing against the housing cover. To correct for this overcompensation, a very small and long control bore is formed in the idler screw, via which the supplied fluid is carried away to the suction side. As a result of this arrangement, a static state develops, depending on the pressure and viscosity of the fluid.

Installing and centering the bushings, which are floating when in the no-load state, is very tedious, because, especially when two idler screws are provided, it is difficult to align the one or both bushings correctly with the ends of the screws, and for this reason it is only with difficulty that the bushing or bushings can be pushed over the ends of the screws, this often requiring multiple attempts.

SUMMARY OF THE INVENTION

The invention is based on the problem of providing a screw pump which shows improvement over what has just been described.

To solve this problem, it is provided according to the invention that the bushing engages with radial play in a receptacle in the cover and comprises a radial flange, by means of which it is supported axially on the housing, and that the ring-shaped flange of the bushing, or at least a certain part of it, engages in the bore and is accommodated there with a certain amount of play.

The screw according to the invention is characterized by a novel arrangement with respect to the support of the bushing. According to the invention, the bushing is no longer screwed to the housing cover but rather is merely inserted with radial play into a receptacle in the cover. It comprises a radial flange, by means of which it is supported axially on the end surface of the housing. This means that the housing extends directly up to the cover. In addition, the cylindrical flange of the bushing, which defines the receiving space, or at least a certain part of this flange, engages with slight play in the bore in which the idler screw is held. This engagement in the bore has the effect of centering the bushing automatically relative to the idler screw.

The configuration according to the invention makes assembly very simple. For the only step which is required is to push the bushing or the bushing in question, as a separate component, onto the end of the screw and thus into the screw bore. Then the housing cover is set in place and positioned with respect to its circumferential orientation so that the bushing engages in the corresponding receptacle in the cover. In this final assembly position, in which the housing cover is then screwed to the housing, the radial flange of the bushing is then arranged between the receptacle, i.e., the housing cover, and the housing and therefore fixed axially in position with slight play. At the same time, after the bushing has been arranged in the receptacle with play and is also simultaneously accepted with slight play in the bore, a certain lateral offset, i.e., compensation for manufacturing tolerances, is possible.

Overall, the screw pump according to the invention is characterized by a much simpler structure, because, now that it is no longer necessary to fasten the bushing to the housing cover by means of appropriate fastening screws or bolts, fewer components are required. In addition, it is characterized by considerable ease of assembly, because the only step which is required is simply to insert the bushing or each of the bushings, which can also be called "blind bushings", into the bore holding the idler screw, after which it remains only to set the housing cover in place. This solution, consisting of simply inserting the parts, also means that the surrounding structure such as the pump body and suction housing do not have to have large diameters to allow assembly of the parts.

It is especially preferred for the cylindrical flange to engage over its entire length in the bore. This means that the bore in which the idler screw is accommodated extends to a point directly at the end of the housing; i.e., it terminates at the end surface of the housing, which means that the bore is not expanded at that point or that any other similar measure is taken.

According to an especially effective elaboration of the invention, the bushing is configured as an aperture in the area of the opening; that is, an aperture opening is provided. An aperture or aperture opening is characterized in that the ratio of the length of the bore of the opening with a small, constant diameter to the diameter itself is approximately 1 or less than 1. This leads in turn to the fact that the pressure drop developing across the aperture is almost independent of viscosity. By means of this control aperture, therefore, the required pressure drop for the axial thrust regulation can be set and regulated, wherein this pressure regulation, i.e., the axial thrust compensation, is completely or almost completely independent of the viscosity of the fluid, so that the screw pump, i.e., the thrust compensation system provided according to the invention, can be used to convey fluids with different viscosities, in contrast to known screw pumps, the thrust compensation systems of which are highly viscosity-dependent. Thus what is obtained is a thrust compensation system in which the outlet pressure, the pressure drop across the aperture, and the selected compensating surface, namely, the diameter of the end surface of the idler screw, interact with each other in such a way that a stable hydrostatic system is formed.

The bushing has an outside diameter which, as described, corresponds to the diameter of the bore holding the idler screw, in which the cylindrical flange is held with slight play. The bushing also has an inside diameter in the receiving space which corresponds to the diameter of the compensating surface on the screw, i.e., the end surface of the screw. The bushing, furthermore, comprises the aperture opening or control aperture, which regulates the required pressure drop for the axial thrust regulation. The idler screw, in contrast, consists, in the area of the axial thrust compensation system, only of a closed diameter; the end of the screw by which it engages in the bushing is therefore a solid cylinder. The diameter of the idler screw in the thrust compensation system, i.e., the section by which it engages in the bushing, is selected so that the pressure-impinged surface, i.e., the end surface of the screw, present in the bushing is somewhat larger than the surface upon which the fluid is able to act. The aperture and the occurring leakage flow, which is carried away from the thrust compensation system to the suction side, are defined in such a way that the pressure drop which occurs is sufficient to correct the overcompensation. In this way, therefore, a self-regulating hydrostatic thrust compensation system can be realized, which is nearly independent of viscosity.

As described above, the viscosity independence of the thrust compensation system is guaranteed by configuring the bushing as an aperture, i.e., as an opening configured as an aperture opening, through which the compensating fluid is supplied. This opening can have a constant diameter over its entire length; this means that the base of the bushing will be correspondingly thin with a total thickness of 2 mm, for example, for an opening with a diameter of 2 mm. Alternatively, it is also possible for the opening to comprise a first section with a constant diameter adjacent to the inlet end, which is followed by a second section, which opens, preferably conically, toward the end surface. With this configuration, the base of the aperture can be made much thicker, since the aperture opening comprises, as it were, several sections. The first section, which has a constant, small diameter, and which defines the degree of the pressure drop across the aperture, is provided directly at the fluid inlet end. This section of the opening is, for example, 2 mm long and has a diameter of 2 mm. The opening then expands toward the end of the screw; the first section therefore merges with a second section, wherein this transition can have a conical shape. The bushing can therefore be configured in various ways.

It is also conceivable that the opening with a constant diameter or the conically expanding section could merge with a circular distributing section open toward the end surface. This means that a recess with a diameter of appropriately large size is provided in the base of the bushing facing the end of the screw; this recess forms a distributing section, to which either a, for example, 2-mm-long opening with a constant diameter leads directly or to which the conically expanding section leads.

Regardless of the concrete configuration of the aperture, it is advisable for the ratio of the length of the opening with constant diameter to the diameter of the opening to be less than or equal to 1. For example, the length of the opening with constant diameter is 2 mm, and the diameter is also 2 mm, so that a ratio of 1 is obtained. The diameter can, however, be somewhat larger, so that a ratio of less than 1 is obtained. The concrete selection of the bore dimensions will be decided as a function of the dimensions of the participating, pressure-impinged surfaces and of the degree of overcompensation at the end of the screw so as to arrive at the pressure loss across the aperture required to correct for the overcompensation.

The use of the aperture, regardless of how it is concretely configured, and thus the possibility of producing a defined, viscosity-independent pressure drop across the aperture makes it possible to set with precision the pressure drop needed to correct for the overcompensation almost completely. As described at the beginning, as a result of the overcompensation of the pressure-impinged surface at the end of the screw, a resultant force develops, which presses the aperture against the housing cover. In the no-load case, i.e., when the pump is therefore not in operation, the bushing is movable laterally, i.e., radially, for the sake of a certain play equalization or compensation for manufacturing tolerances. But when the pump is conveying, a corresponding pressure builds up, from which a force results, which presses the bushing against the housing cover. If this force is relatively large, the lateral or radial mobility of the bushing is no longer present—the bushing is locked in position. This leads in turn to the result that any lateral movement or any lateral migration of the idler screws which may occur during operation leads to the result that the idler screws run up against the inside walls of the cylindrical flanges of the bushings, so that it is possible for abrasion, in the form of abrasive wear, to occur there.

When now, as a result of the thrust compensation according to the invention with the use of the bushing aperture, a defined pressure drop is achieved—which, in conjunction with the given leakage flow, significantly reduces the overcompensation and thus the force by which the bushing is pressed against the housing cover—it is ensured that the bushing is still able to move laterally or radially even under load, i.e., when the pump is operating. This in turn means that the bushing moves along with the corresponding lateral compensating movements of the idler screws, so that the idler screws are always experiencing optimum guidance in the bushing.

As described, the fluid flows toward the bottom surface of the base of the bushing. The base of the bushing for its own part is mounted in the receptacle in the bottom of the housing. To prevent fluid from escaping to the side and thus from not passing through the aperture opening in its entirety, it is advisable to arrange a ring-shaped seal between the housing cover and the bushing. The diameter of the seal is preferably in the range between ±10% smaller or larger than the diameter of the end surface of the screw. This seal defines the pressure surface against which the fluid pushes. The seal prevents, firstly, the fluid from escaping to the side, so that it is guaranteed that the fluid flows only through the aperture opening. Secondly, by giving the seal an appropriate diameter, this pressure surface at the base of the bushing is given a size which corresponds approximately to the opposing pressure surface on the screw, i.e., the end surface of the screw. This is also advisable for the sake of arriving at only a slight opposing force, i.e., the force by which, under load, the bushing is pressed against the housing cover, in order to ensure the lateral mobility of the bushing even when under load.

The seal can be accommodated in a ring-shaped receptacle in the base of the bushing; that is, a ring-shaped groove is formed in the base of the bushing. Alternatively, a ring-shaped receptacle or ring-shaped groove can be formed in the housing cover.

As already described, it is necessary to carry away a leakage flow from the thrust compensation system to the suction side. In the prior art, this is done, as explained, by means of a very long, thin control bore in the idler screw, which comprises an axial bore section and a bore section which proceeds laterally from it, i.e., which extends in the radial direction. The formation of this leakage bore is very time-consuming and complicated. In contrast, according to an especially advantageous elaboration of the invention, the receiving space in which the cylindrical end of the idler screw engages expands conically toward the screw, at least in the area of the free end of the cylindrical flange. The bushing therefore comprises a cylindrical inside circumference proceeding away from the base of the bushing and expanding conically toward the free end of the cylindrical flange of the bushing. The idler screw engages by its cylindrical end in the bushing; it extends into the area of the cylindrical inside circumference. When an appropriate pressure builds up, the idler screw is pushed slightly out of the bushing, which has the result that the end of the screw is moved out slightly in the axial direction away from the cylindrical inside circumference. As a result of the adjoining conically expanding section, a narrow annular gap is opened up between the bushing and the end of the idler screw, through which the fluid can then escape as leakage flow.

The pressure in the thrust compensation system decreases again somewhat; the screw is moved back again slightly into the bushing in the axial direction; the annular gap closes somewhat; a somewhat higher pressure builds up. In this way, a hydrostatic state develops in a very short time, wherein the thrust compensation system brings itself into this hydrostatic state in a self-regulating manner.

The receiving space can expand with an angle in the range of 5-15°, especially of 8-12°, and preferably with an angle of 10°. The area of the conical expansion should advisably extend at least over half the length of the flange and then merge with the cylindrical inside circumferential area, i.e., the area with a cylindrical inside circumference.

According to an especially advisable elaboration of the invention, a ring-shaped collar which reduces the diameter of the flange is provided in the area of the base of the bushing. This ring-shaped collar serves as a contact surface or contact collar, against which the end surface of the screw runs up when the idler screw enters farther into the bushing. In this configuration, the pressure in the thrust compensation system is not strong enough to push the idler screw axially back out again. When the end surface of the idler screw now runs up against the ring-shaped collar, the opposing pressure surface on the idler screw abruptly becomes smaller, since, as a result of the contact with the ring collar, there is now only a reduced end surface on the idler screw against which the fluid can press with its constant fluid pressure. Because, as a result of the axially closed gap, it is no longer possible for fluid to flow away, a correspondingly high pressure builds up which pushes the idler screw axially back out again. An appropriately high pressure thus builds up abruptly in the thrust compensation system, which pushes the idler screw back again in the axial direction. If such a situation occurs when the screw pump is being started up or during its operation, the hydrostatic state is then restored immediately.

The bushing itself is secured against rotating by a locking element on the housing cover, so that it is ensured that the bushing does not turn along with the rotating idler screw. The locking element can be a pin, which engages in a bore on the cover and in a laterally formed receptacle in the end surface of the base of the housing or in the radial flange. It is therefore possible to form either a blind hole in the end surface or a lateral recess, into which the pin can fit.

As previously described, a screw spindle can comprise only a single idler screw and one drive screw. It is also conceivable, however, that two or more idler screws can be provided in associated bores, to each of which a bushing is assigned and which are driven by a common drive screw.

If two or more bushings are provided, these preferably communicate via a common feed line, so that they are supplied simultaneously via a feed line with the fluid, as described, i.e., the medium to be conveyed, so that, overall, a closed fluid circuit is also obtained within the thrust compensation system.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
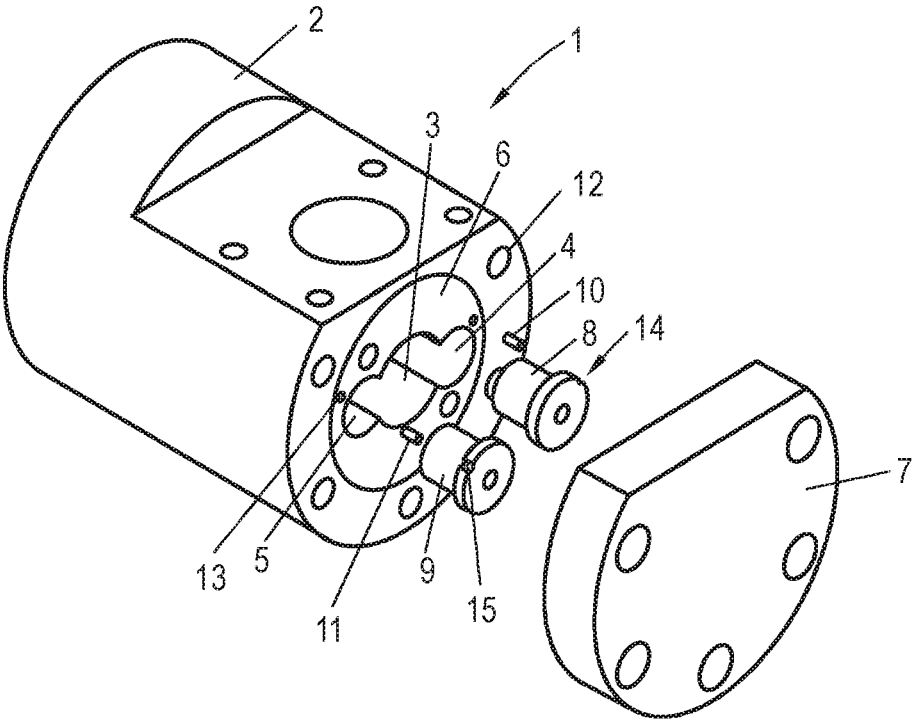
FIG. 1 shows an exploded view, in perspective, of part of a screw pump according to the invention.

FIG. 1 shows a partial, exploded view of a screw pump 1 according to the invention. What is shown is a housing 2, in which a first bore 3 for holding a drive screw is formed in the middle, and in which, laterally offset from that, two additional bores 4, 5 are formed, each of which accommodates an idler screw, which meshes with the drive screw. The screws are not shown. The bores 4, 5 holding the idler screws extend up to a point directly level with the end surface 6 of the housing 2.

As shown is a housing cover 7, which is tightly screwed by suitable fastening screws to the housing 2 and thus closes it off.

Also shown are two bushings 8, 9, which are part of a hydraulic thrust compensation system, by which the two idler screws are axially supported. The design and function of the bushings 8, 9 will be discussed further below. Two pins 10, 11 serve to hold the bushings nonrotatably in position; at one end, the pins are inserted into corresponding, blind holes 12, 13 in the housing, and at the other end they fit into appropriate lateral recesses 14, 15 in the bushings 8, 9. This prevents the bushings 8, 9 from being rotated by the idler screws, which are inserted into them.

Figure 2:
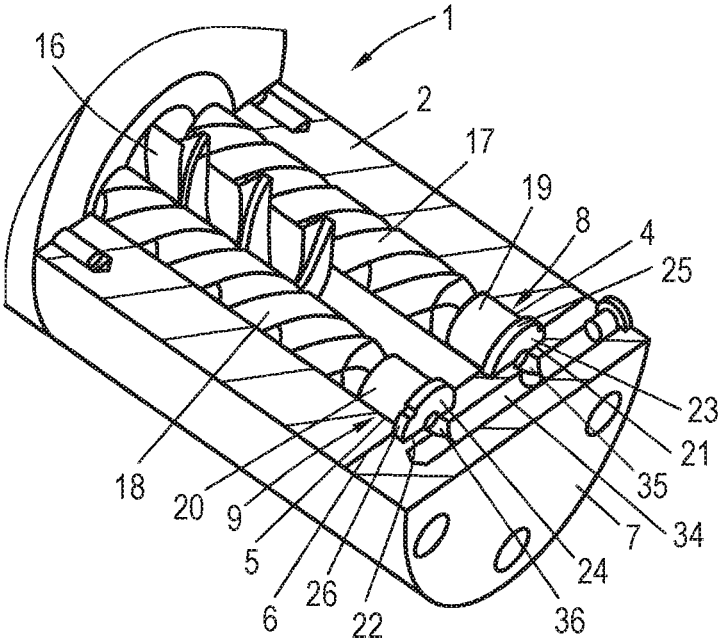
FIG. 2 shows a screw pump according to the invention partially in cross section.

FIG. 2 shows the screw pump 1 of FIG. 1, partially in cross section, wherein it is the housing 2 which is shown in cross section. What can be seen first is the drive screw 16 and the two idler screws 17, 18, wherein the corresponding profiles of the screws mesh with each other. The housing cover 7 is set onto the housing 2 and screwed to it. The two bushings 8, 9 have been pushed onto the idler screws 17, 18; that is, the ends of the screws have been inserted into the bushings 8, 9. It can be seen that each of the bushings 8, 9 has a cylindrical flange 19, 20, by which the bushings are accommodated with slight play in the bores 4, 5 in which the idler screws 17, 18 are held; by this means, the bushings 8, 9 are centered. At their other ends, they are held in corresponding receptacles 21, 22, which are formed in the cover. The base 23, 24 of each bushing is provided with a radial flange 25, 26, which, as will be explained further below, is supported against the end surface 6 of the housing 2.

Also shown is a feed channel 34, which is formed in the housing cover 7, and from which two branch channels 35, 36 proceed, which run to the bushings 8, 9 and which therefore lead to the corresponding receptacles 21, 22. These channels make it possible to supply a pressure-compensating fluid, by means of which the axial thrust compensation is realized.

Figure 3:
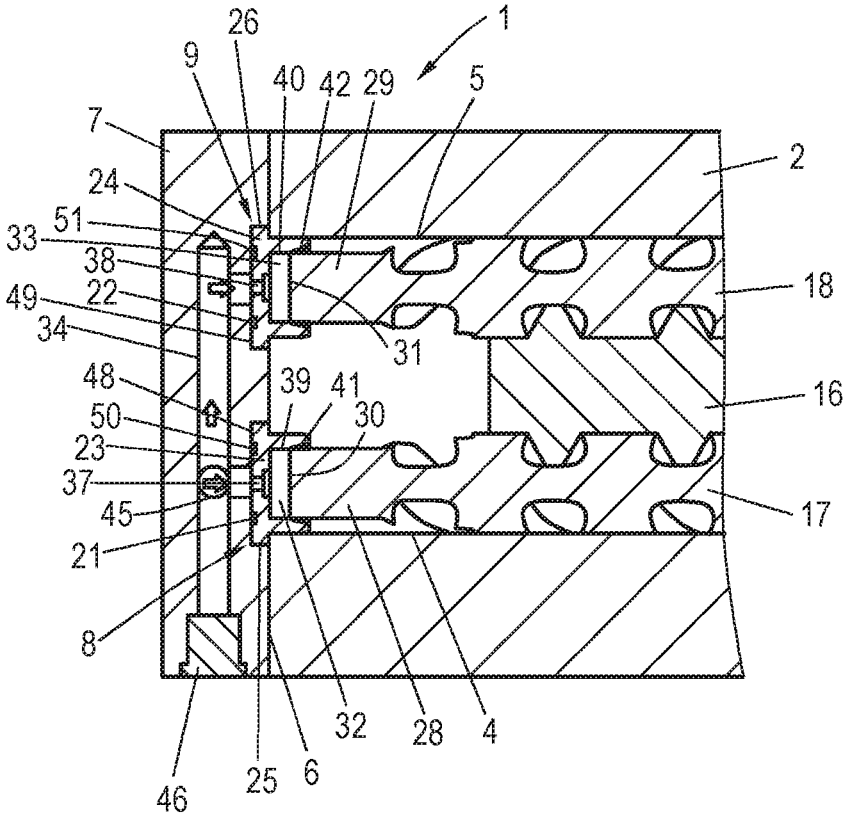
FIG. 3 shows a cross-sectional view corresponding to FIG. 2 with additional cross sections of the bushings and idler screws.

FIG. 3 shows a cross section through the screw pump 1 according to FIG. 2, wherein the drive screw 16 and the two idler screws 17, 18 are also shown, and wherein the bushings 8, 9 are shown in cross section.

It can be seen that the bushings 8, 9 are held in the corresponding receptacles 21, 22. Their radial flanges 25, 26 rest against the end surface 6 of the housing 2, which is possible because the bores 4, 5 extend all the way to the end surface 6, wherein the housing cover 7 rests directly on the end surface 6.

The cylindrical ends 28, 29 of the two idler screws 17, 18 can be seen. It can also be seen that the ends 28, 29 of the screws fit into the bushings 8, 9. They are held in the bushings 8, 9 with minimum play, wherein there is in each case a receiving space 32, 33 formed between the base 23, 24 of the bushing and the associated end surface 30, 31 of the idler screw 17, 18; into this space, the fluid, i.e., the fluid to be conveyed by the pup, is introduced via the feed channel 34 and the two branch channels 35, 36. For this purpose, each bushing comprises an aperture opening 37, 38 in the base 23, 24; through this opening, the fluid supplied via the feed channel 34 and the branch channels 35, 36 can enter the receiving space 32, 33. The fluid flow is represented by the corresponding arrows in FIG. 3.

The bushings 8, 9 are configured as apertures insofar as the associated openings 37, 38 are concerned, as will be explained further below. This means that, by means of these apertures or aperture openings, a defined, viscosity-independent pressure drop from the feed side with the feed channel 34 to the outlet side leading to the associated idler screw 17, 18 can be realized.

As discussed, each of the bushings 8, 9 comprises a cylindrical flange 19, 20. It is with this flange that, as explained, the bushing engages with slight play in the associated bore 4, 5. In addition to its base 23, 24, each flange 19, 20 is provided on its interior surface with a cylindrical inside circumferential area 39, 40 (see FIG. 6 among others), which is followed in each case by a conically expanding area 41, 42 (see again FIG. 6). This configuration makes it possible to regulate the pressure. Depending on how deeply the end 28, 29 of the screw in question extends into the associated bushing 8, 9, an annular gap of greater or lesser size is formed, through which the supplied fluid can flow onward to the suction side of the pump. If the end 28, 29 of the screw is inserted deeply, then the associated end surface 30, 31 is located in the area of the cylindrical inside circumference, i.e., in the circumferential area 39, 40. When the idler screw 17, 18 is pushed back out somewhat by the pressure formed or generated in the receiving space 32, 33, the associated end surface 30, 31 moves into the conical expansion area 41, 42, so that an annular gap is produced, which becomes larger as the idler screw 17, 18 is pushed farther out. The fluid in the receiving space 32, 33 can escape through this annular gap to the suction side, as a result of which the pressure falls again, and the associated idler screw 17, 18 moves back into the bushing 8, 9 to some degree. Overall, this results very quickly in a static equilibrium state, in which the associated idler screw 17, 18 is hydraulically thrust-compensated.

Figure 4:
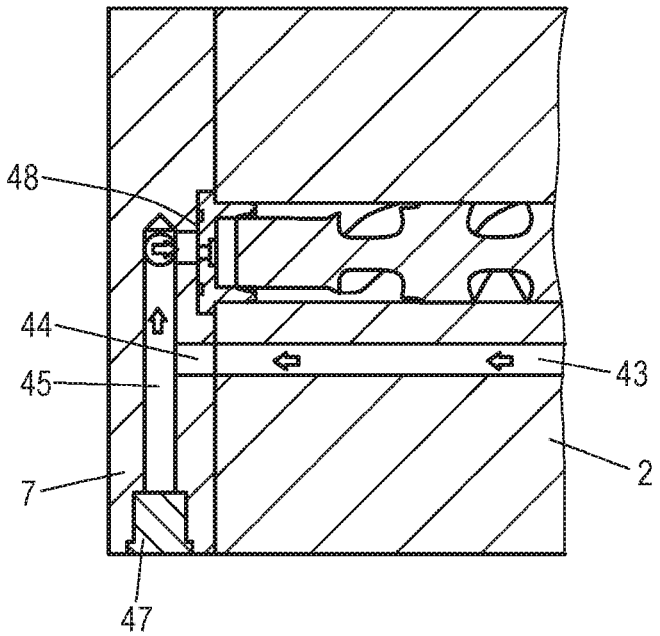
FIG. 4 shows a cross-sectional view in a plane oriented 90° to the plane of FIG. 3.

FIGS. 3 and 4 show the fluid supply of the thrust compensation system comprising the bushings 8, 9 configured and supported in the manner according to the invention. A fluid channel 43 running from the pressure side to the suction side, i.e., to the housing cover 7, is formed in the housing 2; this channel leads via a branch channel 44 to a fluid channel 45 in the cover, which for its own part leads to the feed channel 34. Insofar as necessary, the corresponding channels are closed by sealing plugs 46, 47. The fluid by which the hydraulic thrust compensation is achieved is therefore supplied from the pressure side at the corresponding pump pressure. This pressure acts on the bottom surface 48, 49 of each of the bushings 8, 9. This bottom surface 48, 49 is sealed off against the receptacle 21, 22 by a sealing element 50, 51. For this purpose, corresponding annular grooves 52 are formed in the bases 23, 24 of the bushings (see FIG. 6, where a cross-sectional view through the bushing 8 is shown by way of example), wherein the bushing 8 and the bushing 9 are of identical configuration.

The bushings 8, 9 are held in the corresponding receptacles 21, 22 with slight radial play; they are therefore supported in a "floating" manner with lateral mobility. They are also held by their associated flanges 19, 20 in the bores 4, 5 with slight play, so that a floating support is obtained overall.

This floating support is also retained even under load, i.e., when fluid is being conveyed. In this case, a defined pressure drop occurs across the openings 37, 38, configured as aperture openings, in the bushings 8, 9. This pressure drop is selected so that the force which pushes the bushings 8, 9 against the housing cover 7 (a force which results from the overcompensation attributable to the size of the associated end surfaces 30, 31 of the idler screws 17, 18) is reduced or minimized and compensated to such an extent that, in the loaded state, even though the bushings are pressed tightly against the housing cover 7 under compression of the associated sealing elements 50, 51, they are still able to move laterally, precisely because this resultant force has been largely compensated. This makes it possible for any lateral migration of the associated idler screw 17, 18 to be compensated; that is, the end 28, 29 of the screw in question pushes and carries along the associated bushing 8, 9 laterally, wherein this lateral offset, of course, occurs over a range only a few hundredths of a millimeter. In any case, however, the bushings 8, 9 can move to the side even under load, so that they follow the idler screws 17, 18 and the cylindrical flanges 19, 20 do not attack them abrasively.

Figure 5:
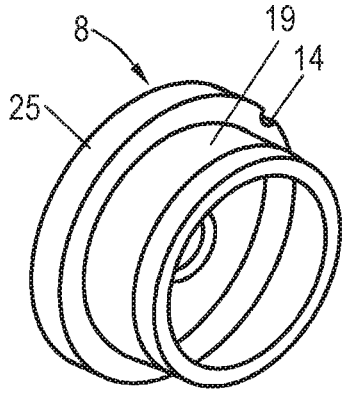
FIG. 5 shows a perspective view of a bushing of the screw pump.
Figure 6:
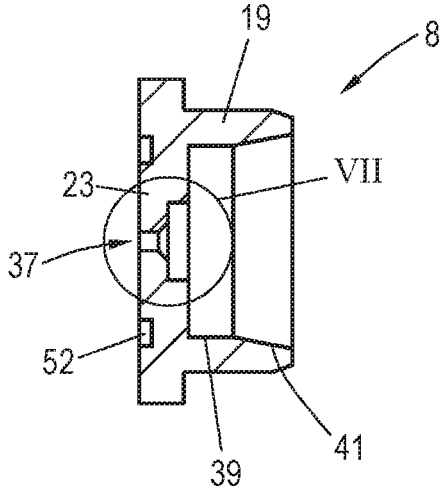
FIG. 6 shows a cross-sectional view through the bushing of FIG. 5.
Figure 7:
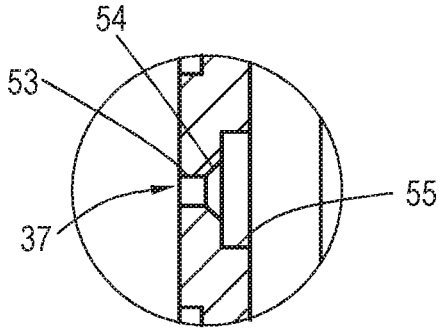
FIG. 7 shows a magnified, detailed view of the area labeled VII in FIG. 6.

FIGS. 5-7 show a first embodiment of a bushing used in accordance with the invention, wherein the bushing 8 is shown by way of example. Bushing 9, of course, is designed in the identical way. It comprises a cylindrical flange 19, and also a radial flange 25, which laterally extends the base 23 of the bushing.

The cross-sectional view of FIG. 6 and the magnified detailed view of FIG. 7 show in detail additional design features of the bushing 8. As can be seen, the conically expanding area 41 of the inside circumference extends over about half or somewhat more than half of the axial length of the flange 19; this is followed by a cylindrical inside circumferential area 39 with a constant diameter.

The opening 37, which is configured as an aperture, is also shown. This area is shown magnified in FIG. 7.

The opening 37 comprises, first, a first section 53, which has a constant diameter. The axial length of this section 53 is preferably equal to the diameter of this cylindrical opening, so that a ratio of 1 is obtained between the length of the opening and its diameter. Alternatively, the ratio can be less than 1; this would mean that the diameter is larger than the length of the opening.

In the example shown, a conically expanding second section 54 follows this first section 53. In this area, the pressure is already beginning to drop, and the process continues in a following distribution section 55.

As previously described, FIG. 6 shows the annular groove 52, in which the corresponding ring seal 50 is seated. The annular groove 52 and thus, after assembly, the ring seal 50 have a diameter which is approximately equal to the diameter of the inside circumferential area 39 and therefore to the diameter of the end surface 30 or 31 as well. This means that the surface at the bottom of the bushing against which the flow impinges is approximately equal to the end surface 30, 31, i.e., to the opposing pressure surface. The "flow impingement" surface is to be seen as the entire surface defined by the associated ring seal 50, 51, because, during operation, although the associated bushing 8, 9 is pressed against the housing cover 7, the bushing 8, 9 can be a certain minimal distance away from the housing cover 7 as a result of the defined pressure drop which has been produced and thus as a result of the equalization of forces, and therefore the fluid can distribute itself over the entire surface bounded by the associated seal 50, 51.

During operation, as described above, the fluid is guided by the associated channel geometry to the associated aperture bushing 8, 9 and enters the associated receiving space 32, 33. The flow thus impinges on the associated end surface 30, 31, i.e., the opposing pressure surface. Because of the defined pressure drop attributable to the configuration of the associated aperture, the forces are largely equalized, so that only a relatively small resultant force occurs, by which the associated bushing 8, 9 is pressed against the housing cover 7, so that, now as before, a floating support is present even under load or pressure conditions.

As a result of the geometry of the inside circumference of the associated bushing 8, 9 according to the invention, a static equilibrium state develops quickly and easily with respect to the axial position of the screw. For the pressure acting on the end surface 30, 31 in question moves the associated idler screw 17, 18 axially relative to the bushing 8, 9, resulting in a corresponding change in the cross section of the associated gap across which the fluid can flow away as leakage flow from the associated receiving space 32, 33, as a result of which a corresponding static state is reached.

The assembly of this thrust compensation system is as easy as could be desired. After the housing 2 has been equipped with the drive screw 16 and the two idler screws 17, 18, the only additional step necessary is to push the two bushings 8, 9 onto the ends 28, 29 of the screws and to introduce the corresponding flanges 19, 20 into the associated bores 4, 5. This results in an automatic centering. At the same time, the bushings are prevented from rotating when the pins 10 engage in the corresponding lateral recesses 14, 15. The only remaining steps are to set the housing cover 7 in place and to position it circumferentially so that the bases 23, 24 of the bushings 8, 9 engage in the corresponding receptacles 25, 26, after which the housing cover 7 can be screwed down.

Figure 8:
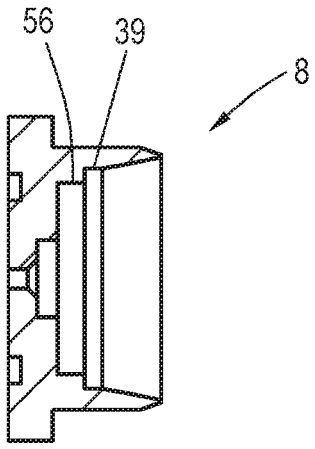
FIG. 8 shows a cross-sectional view through a bushing of a second embodiment.

FIG. 8, finally, shows an embodiment of a bushing 8 according to the invention (the same being true for the bushing 9), in which a ring-shaped collar 56 is formed additionally on the inside circumference in the area 39 with the effect of reducing the diameter at that point. The associated end surface 30, 31 can move against this ring-shaped collar 56 when the idler screw, for whatever reason, enters axially far enough. When the associated end surface 30, 31 runs up against the associated ring-shaped collar 56, the opposing pressure surface, against which the fluid acts, is decreased. Because no more fluid can flow away through the axially closed gap, a correspondingly high pressure builds up which pushes the idler screw back again in the axial direction. That is, the pressure in the associated receiving space 32, 33 increases, which has the effect of pushing the associated idler screw 17, 18 immediately back again out of contact with the associated ring-shaped collar 56, whereupon the static equilibrium state is immediately restored.

Figure 9:
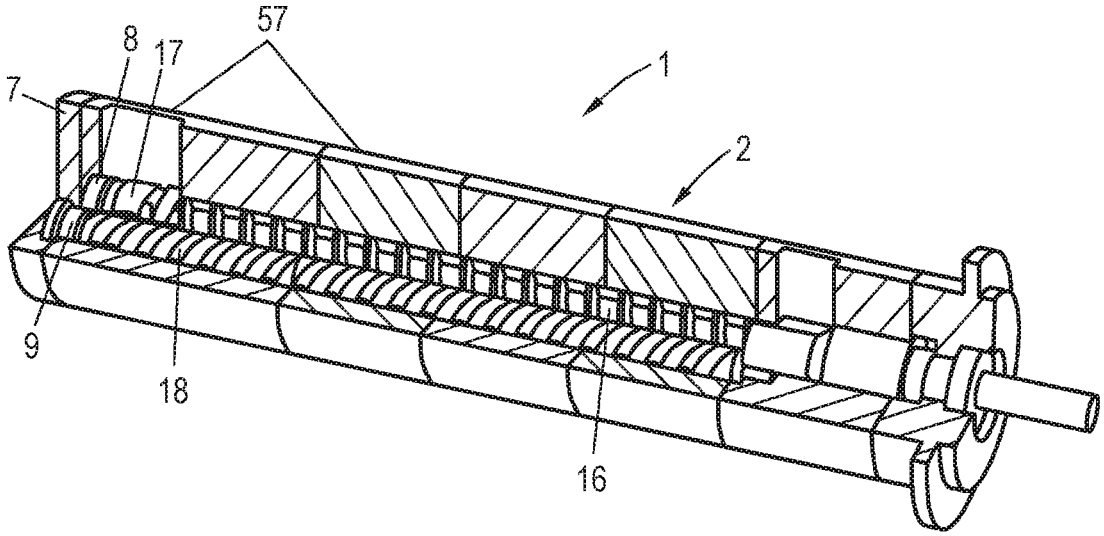
FIG. 9 shows a screw pump according to the invention, partially in cross section, over its entire length.

FIG. 9, finally, shows a cross-sectional view through a screw pump 1 according to the invention, wherein the housing 2 consists here of several separate housing elements 57, which are assembled axially and connected to each other. It is possible to see the housing cover 7 and the axial thrust compensation system realized by the bushings 8, 9, by means of which the two idler screws 17, 18 are hydraulically thrust-compensated.

While specific embodiments of the invention have been shown and described in detail to illustrate the inventive principles, it will be understood that the invention may be embodied otherwise without departing from such principles.

We claim:

1. A screw pump, comprising: a housing; a housing cover; at least one idler screw held in at least one bore in the housing; and at least one bushing arranged on the housing cover; each bushing of the at least one bushing has a receiving space bounded by a cylindrical flange, into which one end of one of the at least one idler screw engages, wherein each bushing of the at least one bushing has a base with an opening, through which a fluid supplied by a feed channel in the housing cover can be supplied from an opposite end of each idler screw of the at least one idler screw, relative to the base, under pressure to an end surface of each idler screw of the at least one idler screw within the receiving space, wherein each bushing of the at least one bushing has a radial flange that engages with radial play in a respective receptacle in the housing cover, the receptacle being open toward the housing, the radial flange being supported axially on the housing; and wherein the cylindrical flange of the bushing engages at least in sections in the bore and is accommodated therein with play so that the bushing floats.

2. The screw pump according to claim 1, wherein the cylindrical flange engages over its entire length in a respective bore of the at least one bore.

3. The screw pump according to claim 1, wherein each bushing of the at least one is configured as an aperture in the area of the opening.

4. The screw pump according to claim 3, wherein the opening has a constant diameter over its entire length, or the opening comprises a first section of constant diameter on an inlet side, followed by a second section facing the end surface.

5. The screw pump according to claim 4, wherein the opening with the constant diameter or the second section merges with a circular distribution section open toward the end surface.

6. The screw pump according to claim 4, wherein a ratio of a length of the opening of constant diameter to the diameter of the opening is <1.

7. The screw pump according to claim 1, wherein, between the housing cover and the at least one bushing, a ring-shaped seal is arranged, the diameter of which is between ±10% than a diameter of the end surface of the at least one idler screw.

8. The screw pump according to claim 7, wherein the seal is seated in an annular receptacle in the base of the at least one bushing or in the housing cover.

9. The screw pump according to claim 1, wherein the receiving space, in which a cylindrical end of the at least one idler screw engages, expands conically in a radial direction toward the at least one idler screw.

10. The screw pump according to claim 9, wherein the receiving space opens with an angle in a range of 5-15° between an axis through a center of the receiving space and an inner surface of the conical expansion in the receiving space.

11. The screw pump according to claim 9, wherein an area of the conical expansion extends over at least half of a length of the cylindrical flange.

12. The screw pump according to claim 9, wherein, in an area of the base of the at least one bushing, a ring-shaped collar reducing a diameter of the cylindrical flange is provided.

13. The screw pump according to claim 1, wherein the at least one bushing is prevented from rotating by a securing element.

14. The screw pump according to claim 13, wherein the securing element is a pin, which engages in a bore in the housing cover or in the housing and also in a receptacle formed in an end surface of the base or laterally in the radial flange.

15. The screw pump according to claim 1, wherein two or more idler screws of the at least one idler screw are provided in associated bores of the at least one bore, to each of which a bushing of the at least one bushing is assigned.

16. The screw pump according to claim 15, wherein each of the bushing of the at least one bushing communicates and is supplied simultaneously with fluid through a common feed line.

17. The screw pump according to claim 4, wherein the second section is conically expanding.

18. The screw pump according to claim 10, wherein the angle is in a range of 8-12°.

19. The screw pump according to claim 18, wherein the angle is 10°.

* * * * *